US007077167B2

(12) United States Patent
Nayfeh et al.

(10) Patent No.: US 7,077,167 B2
(45) Date of Patent: Jul. 18, 2006

(54) BIAS WEAVING MACHINE

(75) Inventors: Samir A. Nayfeh, Somerville, MA (US); Jonathan D. Rohrs, South Deerfield, MA (US); Osamah Rifai, Cambridge, MA (US); Sappinandana Akamphon, Somerville, MA (US); Mauricio Diaz, Santa Catarina (MX); Emily C. Warman, Columbus, OH (US)

(73) Assignee: Massachusetts Institute of Technology, Cambridge, MA (US)

( * ) Notice: Subject to any disclaimer, the term of this patent is extended or adjusted under 35 U.S.C. 154(b) by 32 days.

(21) Appl. No.: 10/928,971

(22) Filed: Aug. 27, 2004

(65) Prior Publication Data

US 2005/0274426 A1 Dec. 15, 2005

Related U.S. Application Data

(60) Provisional application No. 60/579,474, filed on Jun. 14, 2004.

(51) Int. Cl.
*D03D 41/00* (2006.01)

(52) U.S. Cl. ..... 139/11; 139/DIG. 1

(58) Field of Classification Search ..... 139/11, 139/1 R, DIG. 1, 192, 27, 189, 191
See application file for complete search history.

(56) References Cited

U.S. PATENT DOCUMENTS

| | | | |
|---|---|---|---|
| 539,405 | A | 5/1895 | Bancroft |
| 3,359,848 | A | 12/1967 | Ostermann |
| 3,426,804 | A | 2/1969 | Bluck |
| 3,756,533 | A | 9/1973 | De Young |
| 3,799,209 | A | 3/1974 | Dow et al. |
| 3,817,147 | A | 6/1974 | Richardson |
| 3,839,939 | A | 10/1974 | Wily |
| 4,006,759 | A | 2/1977 | Darsie |
| 4,013,103 | A | 3/1977 | Kulczycki et al. |
| 4,015,637 | A | 4/1977 | Halton et al. |
| 4,031,922 | A | 6/1977 | Trost et al. |
| 4,151,866 | A | 5/1979 | Gloor |
| 4,275,638 | A | 6/1981 | DeYoung |
| 4,312,261 | A | 1/1982 | Florentine |
| 4,380,949 | A | 4/1983 | Betta |
| 4,466,469 | A | 8/1984 | Brouwer et al. |
| 4,529,147 | A | 7/1985 | Bull et al. |
| 4,535,674 | A | 8/1985 | Bull et al. |
| 4,719,837 | A | 1/1988 | McConnell et al. |
| 4,898,067 | A | 2/1990 | Ashton et al. |
| 4,922,798 | A | 5/1990 | Ivsan et al. |
| RE33,418 | E | 11/1990 | Krueger |
| 5,067,525 | A | 11/1991 | Tsuzuki et al. |
| 5,070,914 | A | 12/1991 | Fukuta et al. |
| 5,137,058 | A | 8/1992 | Anahara et al. |
| 5,188,153 | A | 2/1993 | Farley |
| 5,228,481 | A | 7/1993 | Kimbara et al. |

(Continued)

*Primary Examiner*—John J. Calvert
*Assistant Examiner*—Andrew W. Sutton
(74) *Attorney, Agent, or Firm*—Sampson & Associates, P.C.

(57) ABSTRACT

A bias-weaving machine is provided. In one embodiment, the bias-weaving machine includes a plurality of yarn carriers, each holding a yarn under tension that extends in a downstream direction towards a woven product. The yarn carriers are translatable in at least one direction other than the downstream direction. The apparatus further includes a plurality of reeds disposed to comb the yarns in a downstream direction. The reeds have a range of motion extending between positions upstream and downstream of the yarn carriers. Embodiment of this invention may advantageously be utilized to weave three-dimensional woven products, such as textile preforms for aerospace composites.

37 Claims, 17 Drawing Sheets

U.S. PATENT DOCUMENTS 5,337,647 A 8/1994 Roberts et al.
5,357,839 A 10/1994 Brookstein et al.
5,375,627 A 12/1994 Iida et al.
5,399,418 A 3/1995 Hartmanns et al.
5,431,193 A 7/1995 Mood et al.
5,435,352 A 7/1995 Yamamoto et al.
5,465,760 A 11/1995 Mohamed et al.
5,501,133 A 3/1996 Brookstein et al.
5,540,260 A 7/1996 Mood
5,720,320 A 2/1998 Evans
5,775,195 A 7/1998 Haehnel et al.
5,775,381 A 7/1998 Addis
5,783,279 A 7/1998 Edgson et al.
5,791,384 A 8/1998 Evans
5,870,940 A 2/1999 Kimbara
5,924,459 A * 7/1999 Evans ..... 139/11
5,947,160 A 9/1999 Addis et al.
6,494,235 B1 * 12/2002 Bruyere et al. ..... 139/11
2002/0069927 A1 6/2002 Bryn et al.

* cited by examiner

BIAS WEAVING MACHINE

RELATED APPLICATIONS

This application claims the benefit of U.S. Provisional Application Ser. No. 60/579,474, entitled Bias Weaving Machine, filed Jun. 14, 2004.

This invention was made with government support under Contract Number F33615-01-C-3145, awarded by the Air Force. The government has certain rights in the invention.

BACKGROUND

1. Technical Field

This invention relates to a weaving machine, and more particularly to a bias-weaving machine suitable for forming three-dimensional woven structures.

2. Background Information

The use of textile preforms is well known in the composite industry. Such preforms are commonly fabricated using relatively simple weaving machines that typically produce flat, substantially two-dimensional woven products with yarns extending in only two directions. Such materials are generally formed by interlacing two sets of yarns substantially perpendicularly to each other. In such two-dimensional weaving applications, the 0 degree yarns are referred to as warp yarns, while the 90 degree yarns are referred to as fill yarns. The introduction of bias yarns (e.g., interwoven at 45 degrees, into the weave is also known to produce materials having superior shear strength and off-axis tensile strength.

Three-dimensional preforms are often formed by joining a plurality of two-dimensional woven materials, for example into "T" or "Pi" shapes. Typically, simple two-dimensional woven fabrics are produced by a material supplier and sent to a customer who cuts out patterns and lays up the final preform ply by ply. Such joining operations are typically time and labor intensive and therefore expensive. Moreover, composites formed by such operations are known to sometimes have compromised mechanical properties at the joints and between the various plies. In other applications, a bias cloth may be laid up with three-dimensional woven preforms having only fill and warp yarns. While such a process may reduce time and labor requirements as compared to a full lay-up, it remains expensive. Moreover, delamination between the bias cloth and the woven preforms is a common problem.

One approach to overcome such difficulties in forming three-dimensional woven preforms is to weave the bias yarns among the warp and fill yarns. One attempt to provide such functionality is described in U.S. Patent Application Publication No. U.S. 2002/0069927, entitled Three-Dimensional Woven Forms with Integral Bias Fibers and Bias Weaving Loom, published on Jun. 13, 2002 (hereinafter, the '927 application). This approach, however, is not without its drawbacks. Therefore, there exists a need for an improved weaving apparatus for forming three-dimensional woven structures including a plurality of bias yarns, such as those required for advanced composite material applications.

SUMMARY OF THE INVENTION

In one aspect the present invention includes an apparatus for interweaving of yarns. The apparatus includes a plurality of yarn carriers, each of which holds a yarn under tension. The yarns extend in a downstream direction from an end supported by the carriers towards a woven product. The apparatus further includes a plurality of reeds disposed to comb the yarns in the downstream direction. The reeds have a range of motion extending between positions upstream and downstream of the yarn carriers. The yarn carriers are translatable in at least one direction other than the downstream direction.

In another aspect, this invention includes an apparatus for the interweaving of yarns. The apparatus includes a plurality of yarn carriers, each of which holds a yarn under tension. The yarns extend in a downstream direction from an end supported by the carriers towards a woven product. The apparatus further includes a shuttle configured to releasably engage at least one of the yarn carriers to translate the engaged yarn carrier(s) relative to at least one other of the yarn carriers in a direction substantially orthogonal to the downstream direction. The shuttle includes a plurality of opposable engagement configured to opposably engage one or more of the plurality of yarn carriers. The engagement members are configured to asynchronously, alternately engage and release the yarn carriers to translate the engaged bias yarn carriers.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1A:
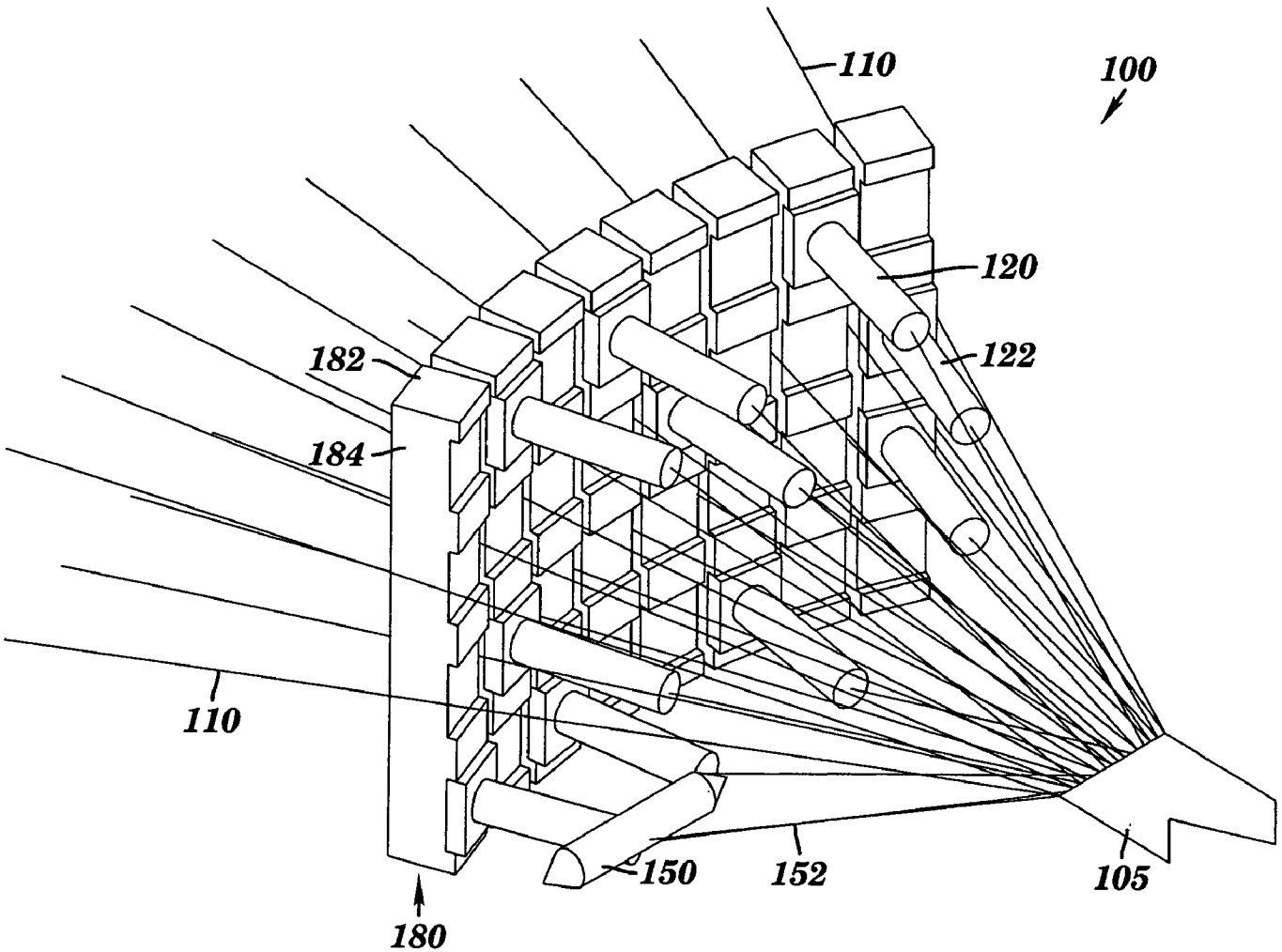
FIGS. 1A, 1B, and 1C are schematic isometric, top, and side views, respectively, of one embodiment of an apparatus in accordance with this invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals. Moreover, it will also be understood that directional designations such as 'left', 'right', 'up' and 'down' are used herein for ease of reference only, and are not intended to be limitations on the invention. The artisan of ordinary skill will of course recognize that the embodiments and portions thereof described herein may be utilized in substantially any orientation, without departing from the spirit and scope of the present invention.

Exemplary aspects of the present invention are intended to address the above described need for an improved apparatus for interweaving yarns, and in particular for interweaving three-dimensional fiber preforms for fiber composite materials, such as those used in the aerospace industry. Referring briefly to the accompanying figures, exemplary embodiments of this invention include an apparatus having a plurality of warp yarn carriers, a plurality of bias yarn carriers, and a fill yarn shuttle. The bias yarn carriers are translatable in at least one direction other than the downstream direction. Embodiments of the apparatus also include a plurality of reeds disposed to comb the yarns in the downstream direction. The reeds include a range of motion extending between positions upstream and downstream of the bias yarn carriers.

Exemplary embodiments of the present invention may provide several technical advantages. For example, weaving machines in accordance with this invention may be utilized to fabricate substantially three-dimensional woven products having a plurality of interwoven layers that include bias yarns and therefore exhibit superior strength and stiffness. Moreover, embodiments of this invention may reduce labor and expense requirements in producing three-dimensional woven products including bias yarns. These embodiments also tend to be less complex than prior approaches, which generally provides increased reliability and operational availability.

Figure 1B:
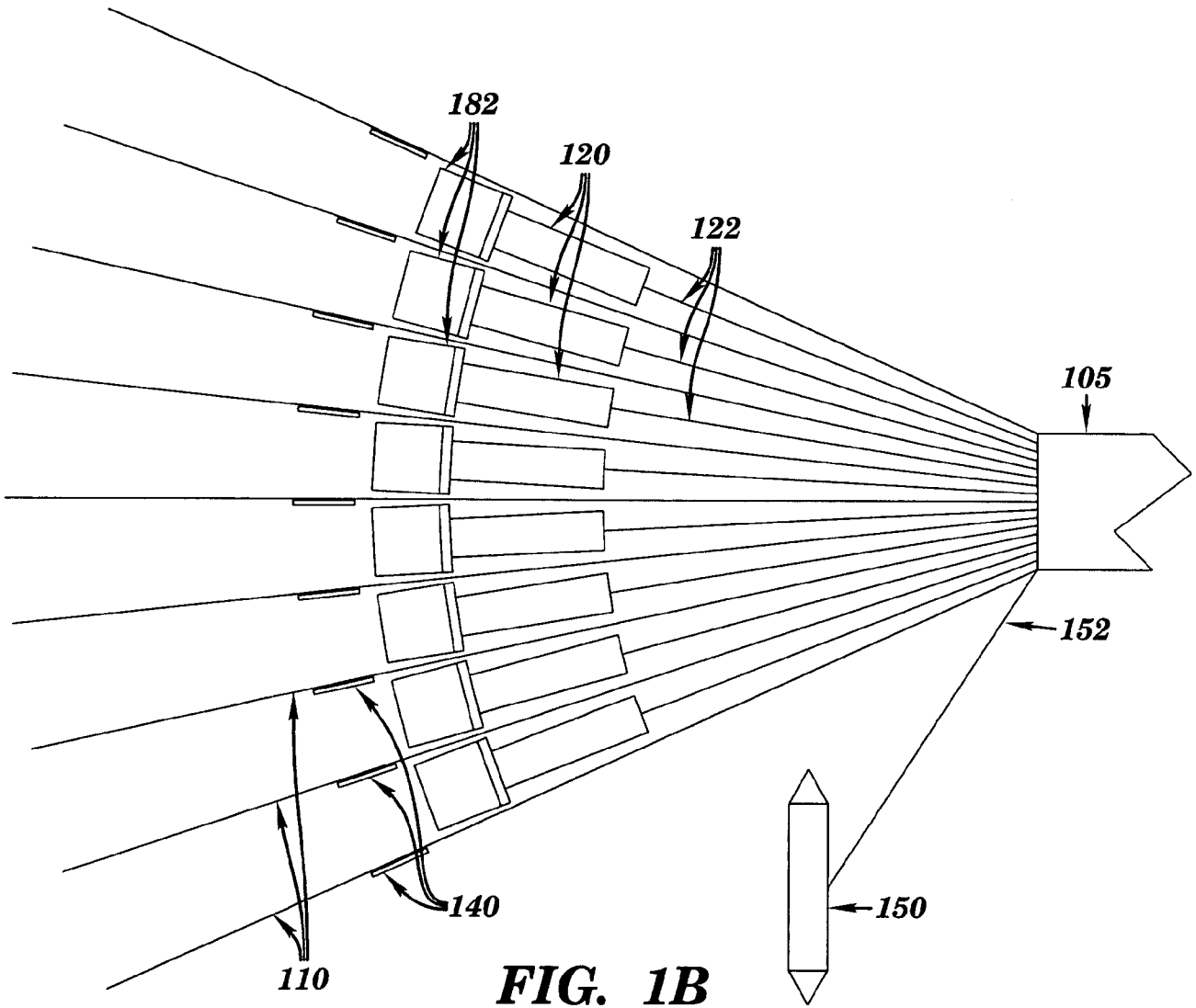
Figure 1C:
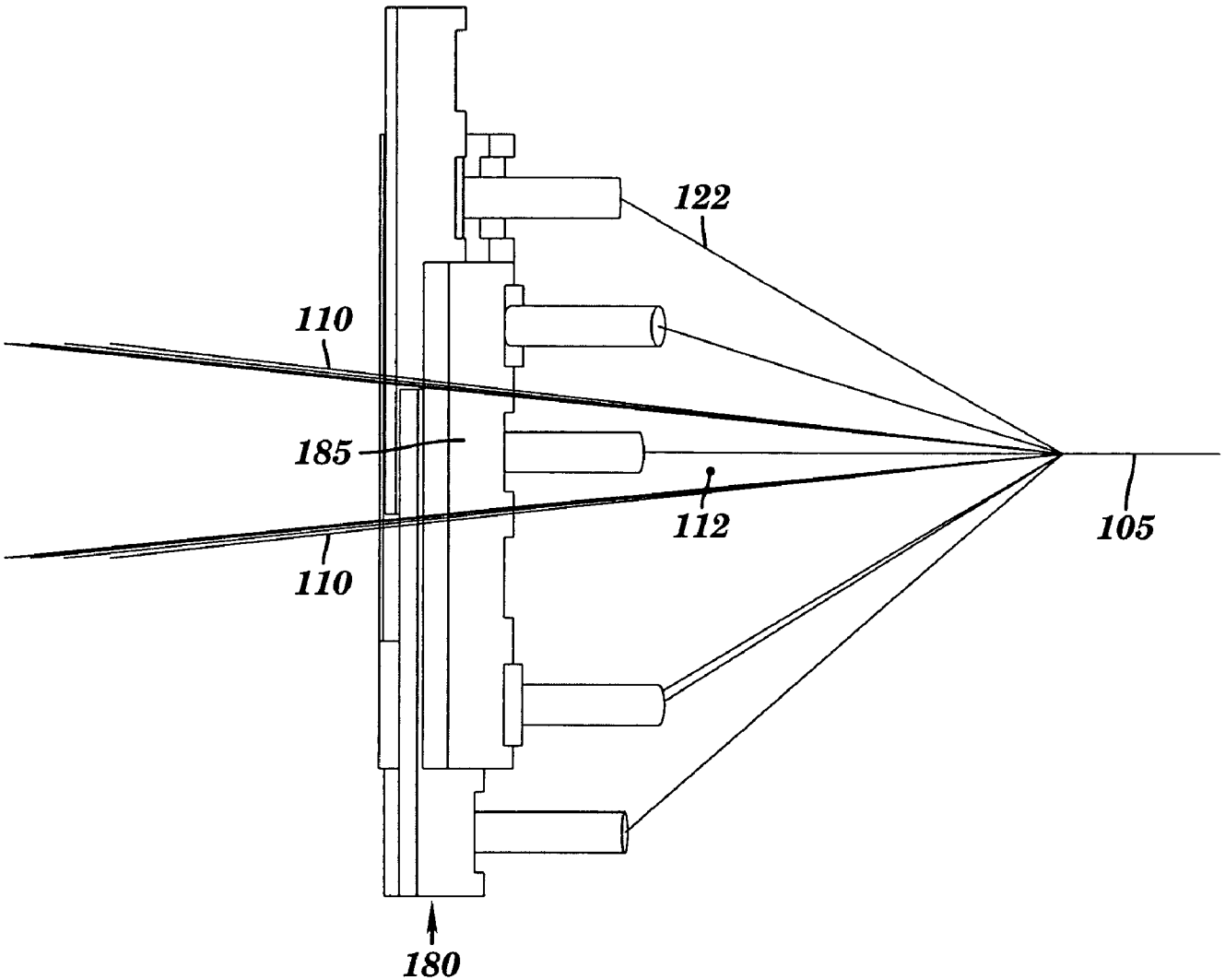

With reference now to FIGS. 1A through 1C, one exemplary embodiment of a weaving apparatus 100 in accordance with this invention is shown and described. Exemplary embodiments of apparatus 100 may be suitable for weaving three-dimensional structures, such as woven product 105, that include a plurality of warp yarns 110 and a plurality of bias yarns 122. In the embodiment shown on FIGS. 1A through 1C, weaving apparatus 100 includes a plurality of warp yarns 110 disposed to form a shed 112 (FIG. 1C), a plurality of bias yarn carriers 120, a plurality of reed blades 140 disposed to comb various bias 122 and fill 152 yarns towards the woven product 105, and a shuttle 150 disposed to move a fill yarn 152 through the shed 112 in a direction substantially transverse to the warp yarns 110. Prior to inserting fill yarn 152, the individual warp yarns 110 may be moved up or down to determine whether the individual warp yarns 110 are passed over, or are are passed under, by the fill yarn 152. Likewise, the bias carriers 120 may also be moved (as described in more detail below with respect to FIGS. 3A through 5B) to determine which of them the fill yarn 152 passes between. This process of moving the warp yarns 110 and bias yarns 122 effectively forms the shed 112. After the shed 112 is formed, the fill shuttle 150 may be passed therethrough.

Figure 2:
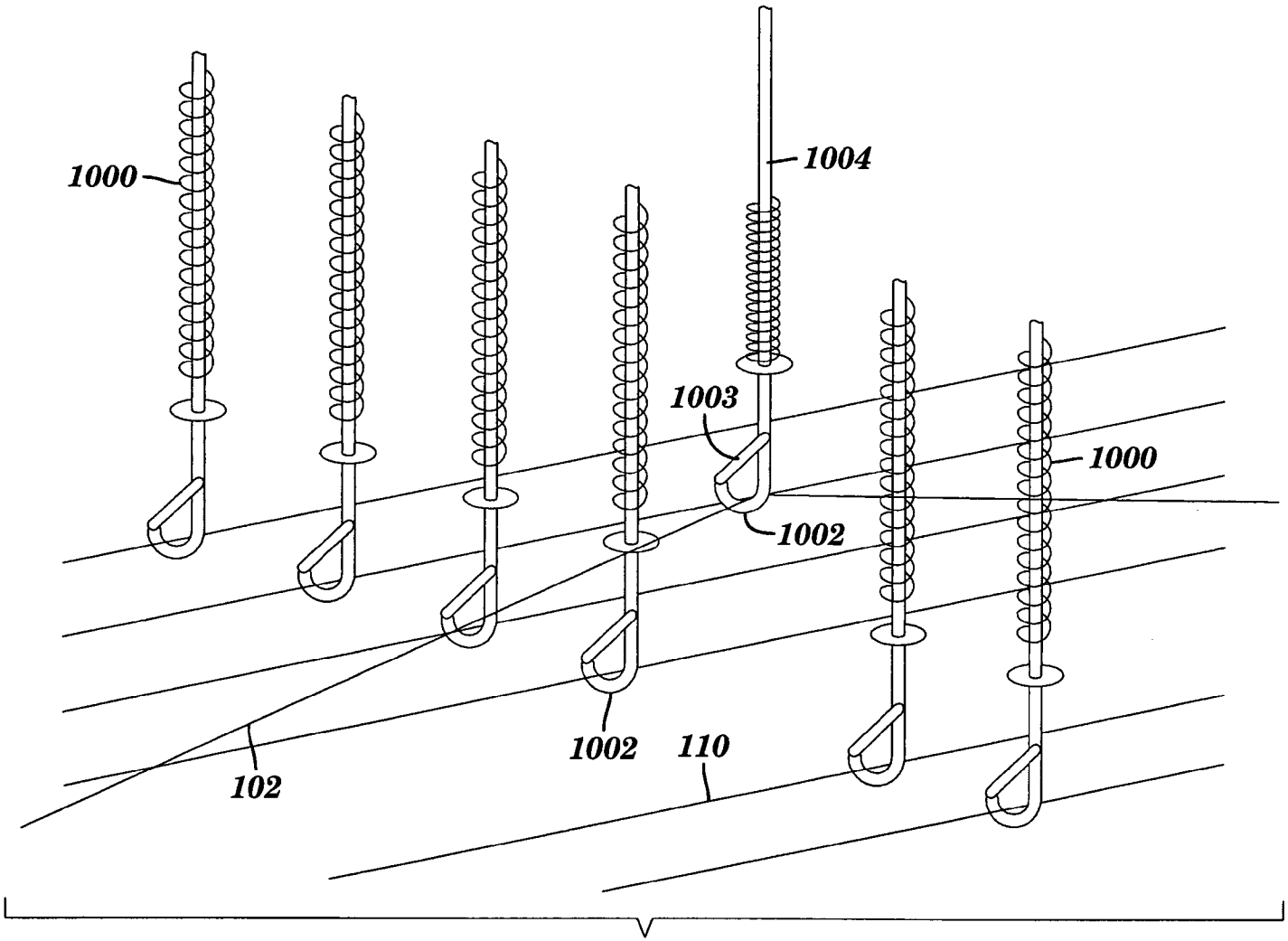
FIG. 2 depicts a prior art Jacquard control system illustrating a series of individual heddles holding warp yarns.
Figure 3A:
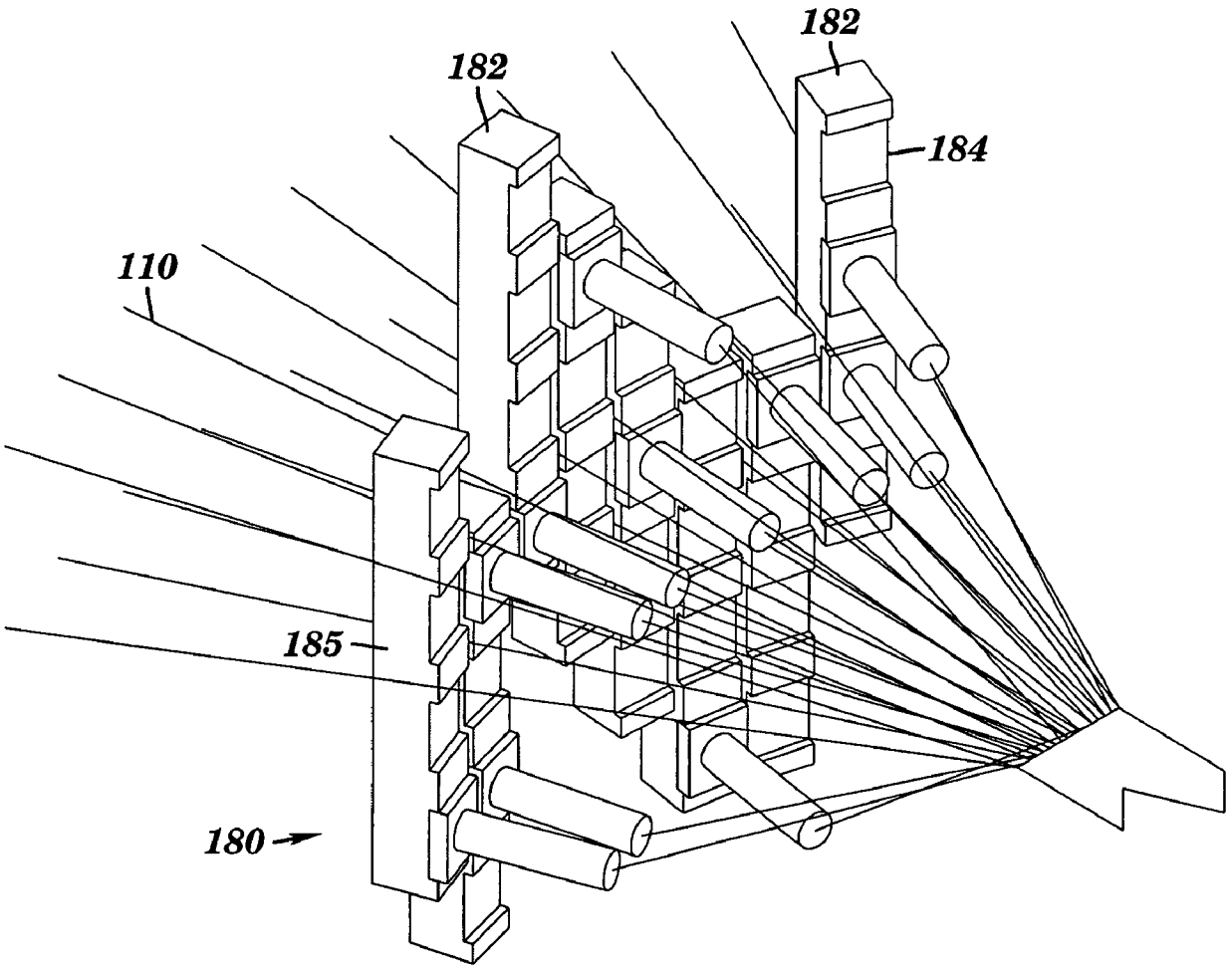
FIGS. 3A and 3B are isometric, schematic views of the apparatus of FIG. 1A illustrating one embodiment of bias shuttle control.
Figure 3B:
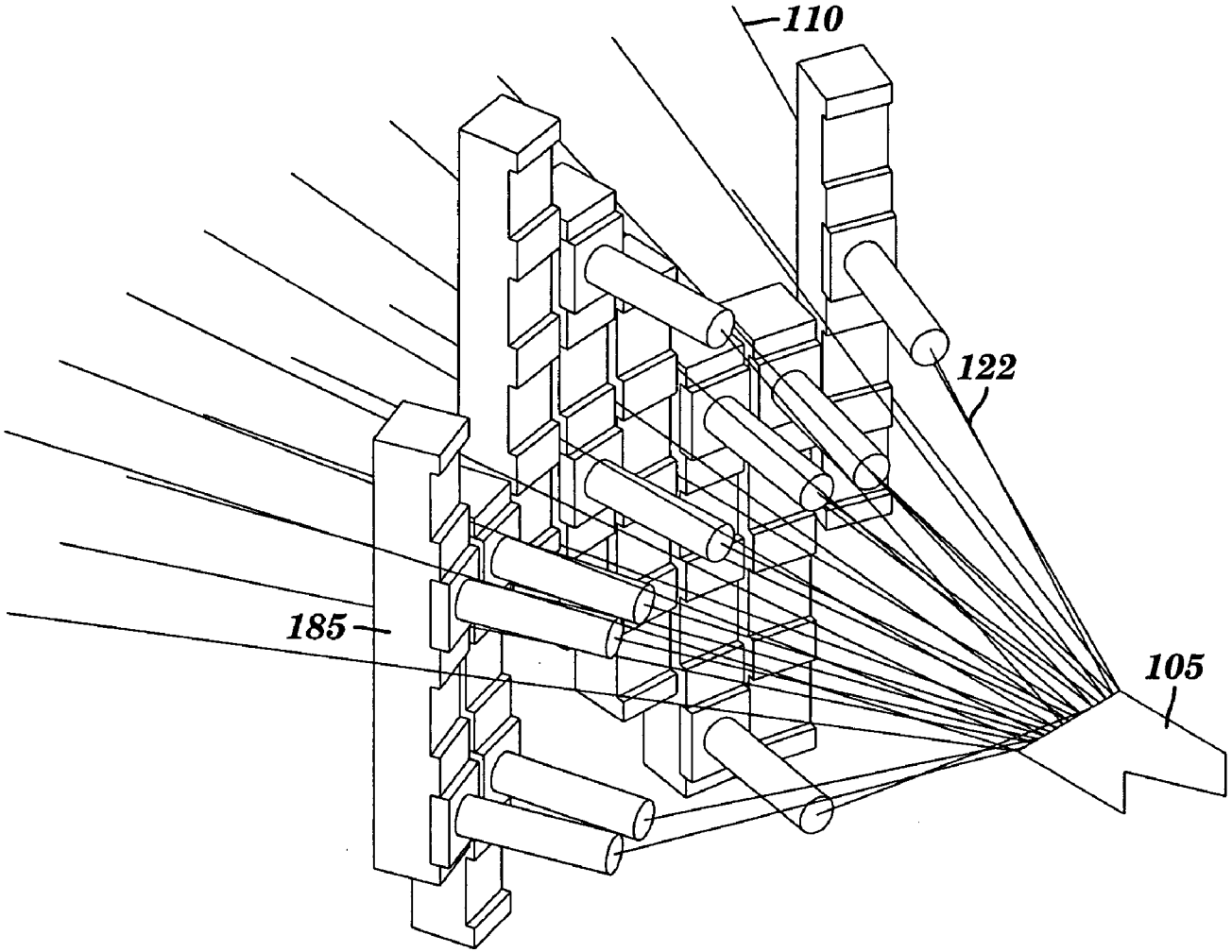

It will be understood that the warp yarns may be moved using substantially any suitable actuation technique. For example, Jacquard control is one method of forming three-dimensional woven forms. A Jacquard control system advantageously allows individual heddles to be raised and lowered in any combination, rather than only a preset number of combinations determined by the harnesses in the loom. This is illustrated in FIG. 2, which is abstracted from the aforementioned '927 application, and shows a series of individual heddles 1000, holding warp yarns 110. Each of these exemplary heddles 1000 employs a hook 1002 with a clasp 1003 to hold the warp yarns 110. Heddle 1004 is shown in a raised position, thereby forming a shed.

Referring again to FIGS. 1A through 1C, the bias yarn carriers 120 are typically deployed on a bias shuttle 180 having a plurality of columns 182 and rows 184. The columns 182 are interposed with warp yarns 110, with the unwoven warp yarns 110 spreading radially outward from the woven product 105 (i.e., in the upstream direction) to accommodate the breadth of the columns 182. Each column 182 typically includes one or more bias yarn carriers 120 deployed thereon, e.g., with various exemplary embodiments of weaving apparatus 100 including 120 or more bias yarn carriers. One exemplary embodiment of this invention is configured to horizontally translate a bias carrier 120 located within a single row (translatable row 185 shown on FIG. 1C). The bias carriers 120 in each of the columns 182 may typically be translated up or down, as shown schematically in FIGS. 3A and 3B, in order to line up one or more predetermined bias carriers 120 in the translating row 185. It will be appreciated that the warp shed 112 may be modified at this time, as described above, so that each warp fiber is above or below the translating row 185 as desired. The bias carriers 120 along the translating row 185 may then be moved together to the right or left as desired (as shown by comparing FIGS. 3A and 3B). In this manner one or more particular bias carriers 120 may be repositioned to substantially any one of a plurality of positions on the bias shuttle 180.

Figure 4A:
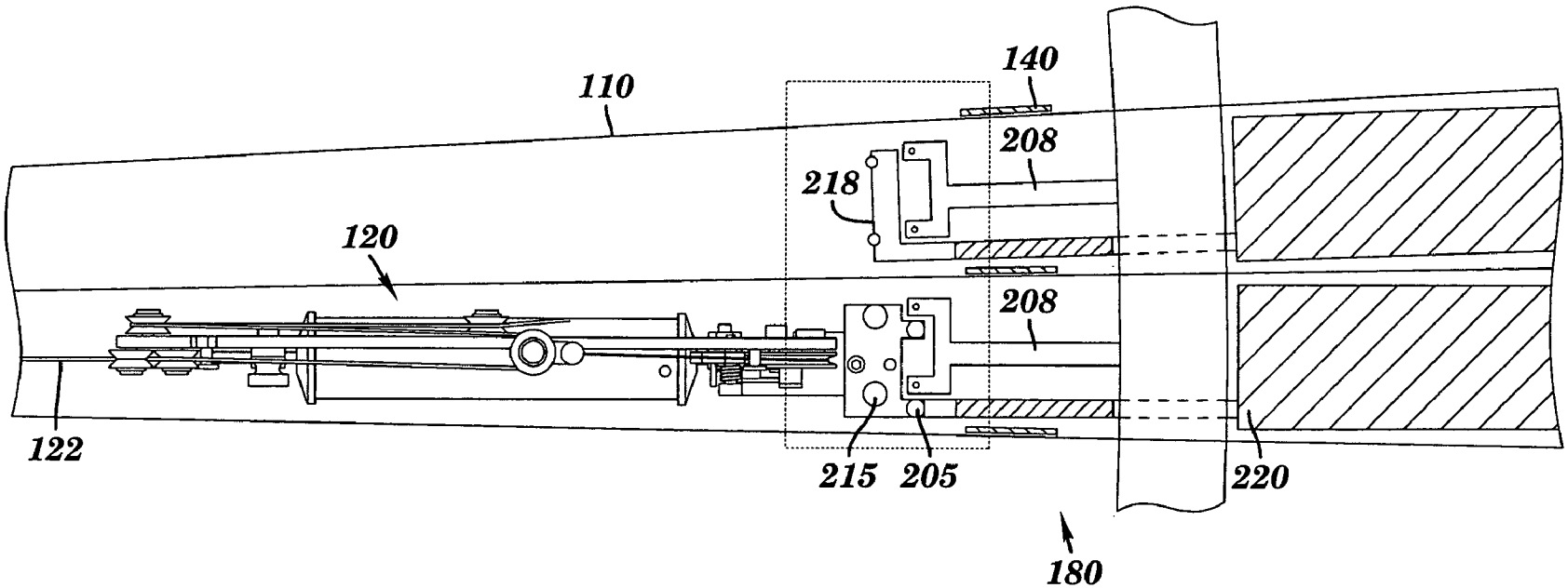
FIGS. 4A and 4B are top and side views of a specific embodiment of a bias shuttle portion useful in the embodiment of FIG. 1A.

With reference now to FIGS. 4A through 5B, one exemplary embodiment of bias shuttle 180 is described in more detail. FIGS. 4A and 4B show top and side views, respectively, of a simplified bias shuttle having only two columns. It will be appreciated that the embodiment shown on FIGS. 4A and 4B is simplified for clarity and ease of exposition and that the bias shuttle may be extended to include substantially any number of columns by repeating the pattern shown. As shown, bias carrier 120 (described in more detail below with respect to FIGS. 6A and 6B) includes upper grips 202 and lower grip 204 grips for coupling with the bias shuttle 180. Grips 202 and 204 are configured to slide vertically relative to one another. Each grip 202 and 204 includes a plurality of indentations (or through holes) 205 and 215 formed therein. Indentations 205 are sized and shaped to receive one or more tines 206 disposed on upper 208 and lower 210 forks, while indentations 215 are sized shaped to receive the upper 216 or lower 217 pins disposed on column fronts 218. The column fronts 218 of a particular column 182 (FIG. 1A) may be moved vertically by actuating column backs 220. The upper 208 and lower 210 forks may be moved horizontally independently of one another within translating row 185 (FIGS. 3A and 3B) by actuating upper 222 and lower 224 shift bars, which are respectively coupled thereto. In the embodiment shown in FIG. 1A, the columns 182 are arranged in a slightly arcuate fashion about the woven product 105. Thus the shift bars 222 and 224 may be rotated slightly relatively to one another, about a vertical axis (e.g., located at the woven product 105). It will be appreciated that analogous linear arrangements may also be utilized.

Figure 4B:
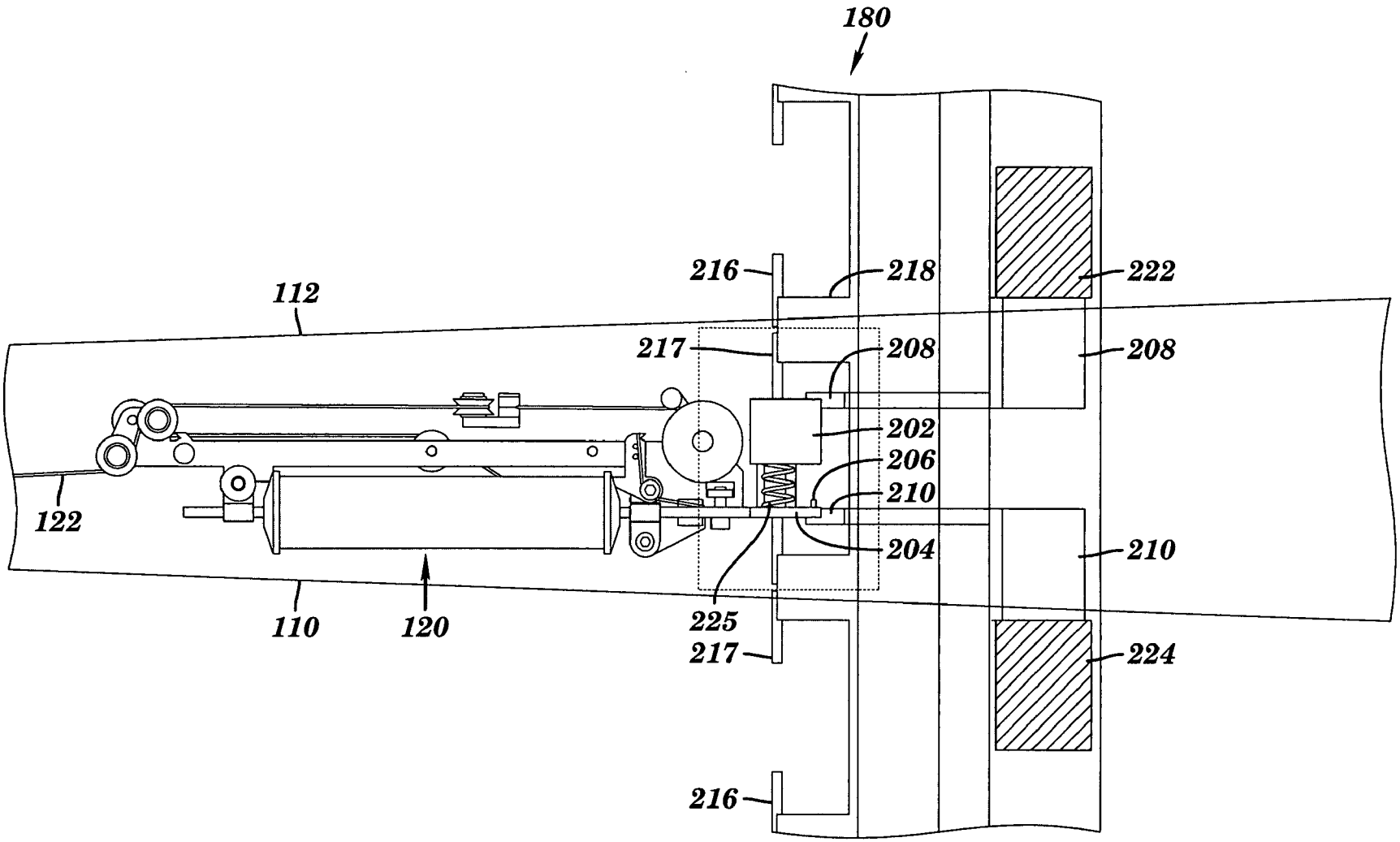

With continued reference to FIGS. 4A and 4B, when not translating, the bias carriers 120 are carried on the column fronts 218 with column pins 217 and 216 engaging the upper 202 and lower 204 grips, respectively. The upper 222 and lower 224 shift bars (which support forks 208 and 210 as discussed above) are generally interposed between the columns 182, and permit the column fronts 218 and the bias carriers 120 to move vertically (e.g., with their respective columns) without interfering with the forks 208 and 210 when disposed as shown. Column pins 216 and 217 typically remain interposed between adjacent warp yarns. It will be appreciated that the above-described structure also enables the bias carriers 120 to move horizontally (in translating row 185) without interfering with column fronts 218, as discussed below.

Figure 5A:
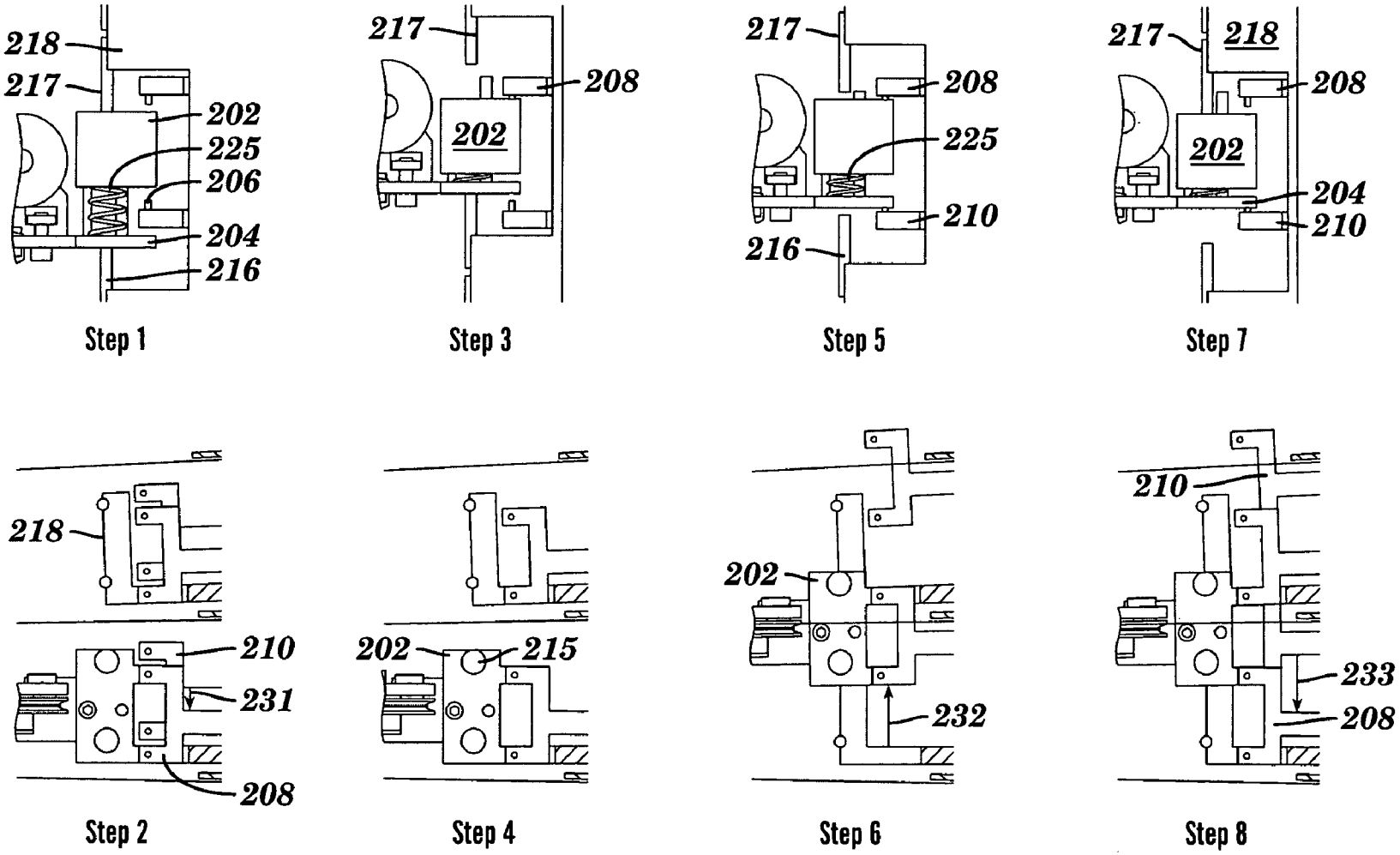
FIGS. 5A and 5B are a series of views similar to those of FIGS. 4A and 4B, depicting an exemplary procedure for translating a row of bias carriers.
Figure 5B:
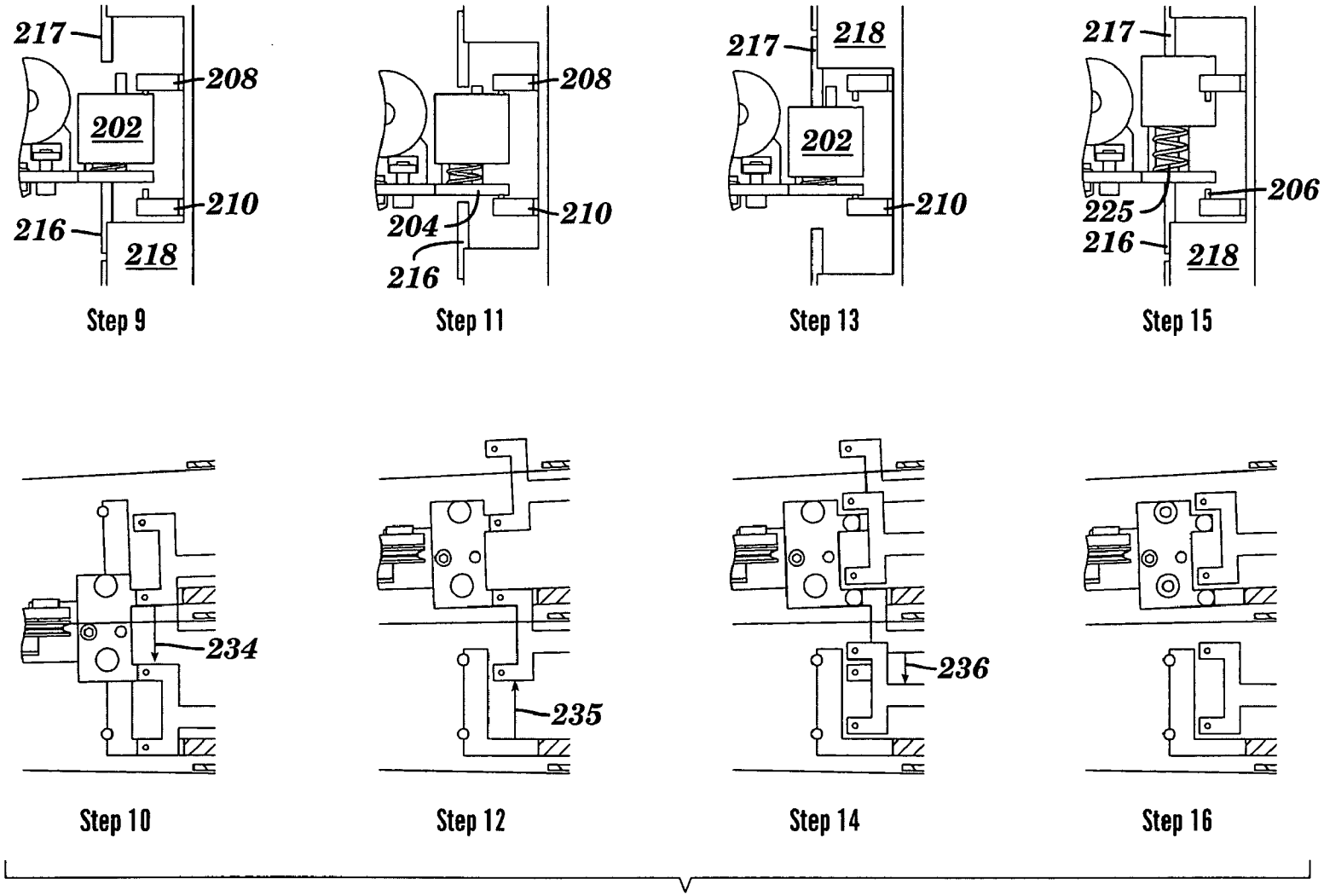

Turning now also to FIGS. 5A and 5B, horizontal translation of the bias carriers 120 within the translating row 185 is described in more detail by describing a left-shift sequence of a single bias carrier 120 from one column to an adjacent column. In step 1, the column fronts 218 are moved to a lower position. In step 2, the upper fork 208 is moved right (as shown at 231) thereby locating its tines 206 directly above indentations 205 in upper grip 202. The column fronts 218 are then moved upwards in step 3 so that the indentations 205 in upper grip 202 engage the tines 206 in upper fork 208. The column fronts are then moved upwards until spring member 225 is substantially compressed. In this upper position, lower column pins 217 are disengaged from indentation 215 in upper grip 202. In step 4, lower fork 210 is moved to the right position (i.e., directly beneath upper fork 208), thereby locating its tines beneath lower grip 204. In step 5, the column fronts 218 are moved downwards to a center position (at which spring member 225 is partially compressed) so that indentations 205 in lower grip 204 engage the tines 206 in the lower fork 210.

In this position, both the column pins 216 and 217 are disengaged from the upper 202 and lower 204 grips. As such, the bias carrier 120 in translating row 185 (i.e., the row shown) is supported by both forks 208 and 210. The upper and lower shift bars 222 and 224 are then moved together to the left (along with the forks 208 and 210 which support bias carrier 120) in step 6 as shown at 232. As such, the grips 202 and 204 pass between the column pins 216 and 217. After the completion of step 6 the bias carriers 120 have been moved half way to the adjacent column.

With continued reference to FIGS. 4A through 5B, the column fronts 218 are moved to their lower position in step 7. The lower column pin 217 engages upper grip 202 pushing it downward, to disengage upper fork 208 from the upper grip 202. After step 7, the bias carriers are supported by the lower column pins 217 and the lower forks 210. In step 8, the upper fork 208 is moved to its right most position (as shown at 233), thereby locating tines 206 above indentations 205 in upper grip 202. In step 9 (shown on FIG. 5B), the column fronts 218 are moved upwards to the upper-most position so that the upper column pins 216 engage and lift the lower grip 204, which disengages lower grip 204 from lower fork 210 and engages upper grip 202 with upper fork 208. After step 9, the bias carrier 120 remains between adjacent columns and is supported by the upper column pins 216 and the upper forks 208. In step 10, the lower fork is moved to the right (as shown at 234) so that tines 206 are located directly below indentations 205 on lower grip 204. In step 11, the column fronts 218 are again moved to their center positions such that lower grip 204 disengages upper column pins 216 and re-engages lower fork 210. After step 11, the bias carriers are again supported by the upper 208 and lower 210 forks. In step 12, the upper and lower forks are moved, along with bias carriers 120, to the left as indicated at 235.

Upon completion of step 12, the bias carrier 120 has been fully moved to the adjacent column, however, it effectively straddles adjacent pairs of upper 208 and lower 210 forks, and needs to be re-engaged with the corresponding column pins 216 and 217. Thus, in step 13, the column fronts 218 of the adjacent column are moved downwards so that the lower column pins 217 engage upper grip 202 pushing it downward against the bias of spring member 225 so that it disengages upper fork 208. In step 14, the upper fork is moved right to its center position as indicated at 236. In step 15, the column fronts are moved upwards to the uppermost position. The upper column pins 316 engage the lower grip pushing it upwards so that it disengages the lower fork 210. After step 15, the bias carrier 120 is again supported by the column fronts 218. In step 16, the lower fork 210 is returned to the center position directly below the upper fork 208. After step 16 the bias carrier 120 may move vertically in columns 182 as described above. Alternatively, the bias carrier may be moved further to the left by repeating the above-described procedure.

Thus, as described, this embodiment effectively provides a bias shuttle in which opposable engagement members (e.g., upper and lower forks) opposably engage one or more of the plurality of yarn holders. Moreover, these engagement members are configured to asynchronously, alternately engage and release the yarn holders to effectively translate the engaged yarn holders. Furthermore, the engagement members accomplish this by effectively handing off the yarn holders to supports that remain interposed between the warp yarns.

The artisan of ordinary skill will readily recognize that numerous variations on the above-described sequence are possible. For example, the roles of the upper and lower column fronts 218 and the upper 208 and lower 210 forks may be reversed so that the lower forks 210 (rather than the upper forks 208) are moved first in step 2. It will also be appreciated that a right-shift sequence may be established by simply reversing a left-shift sequence and vice-versa.

Figure 6A:
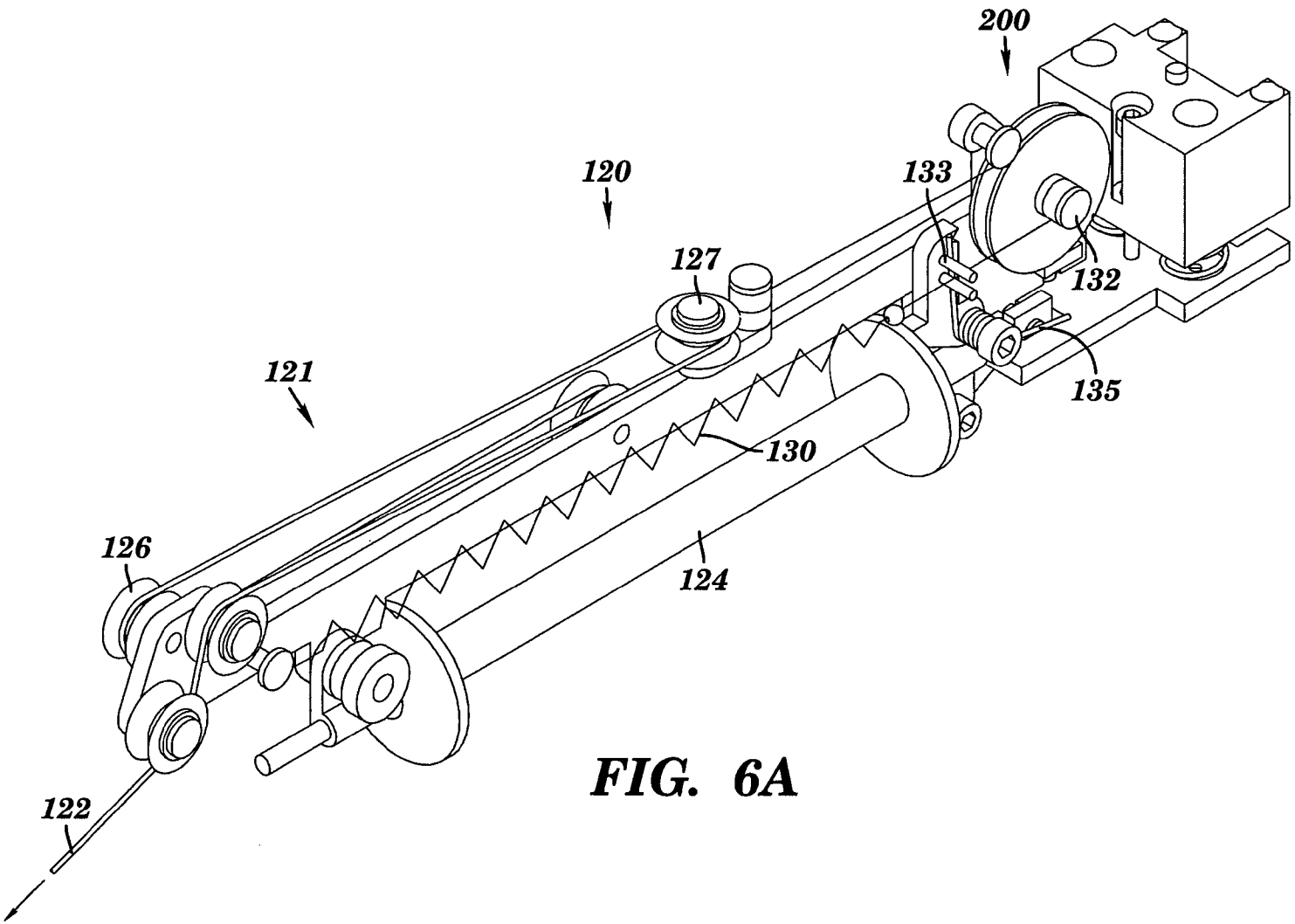
FIGS. 6A and 6B are isometric and side views of a bias carrier portion useful with the embodiment shown in FIG. 1A.
Figure 6B:
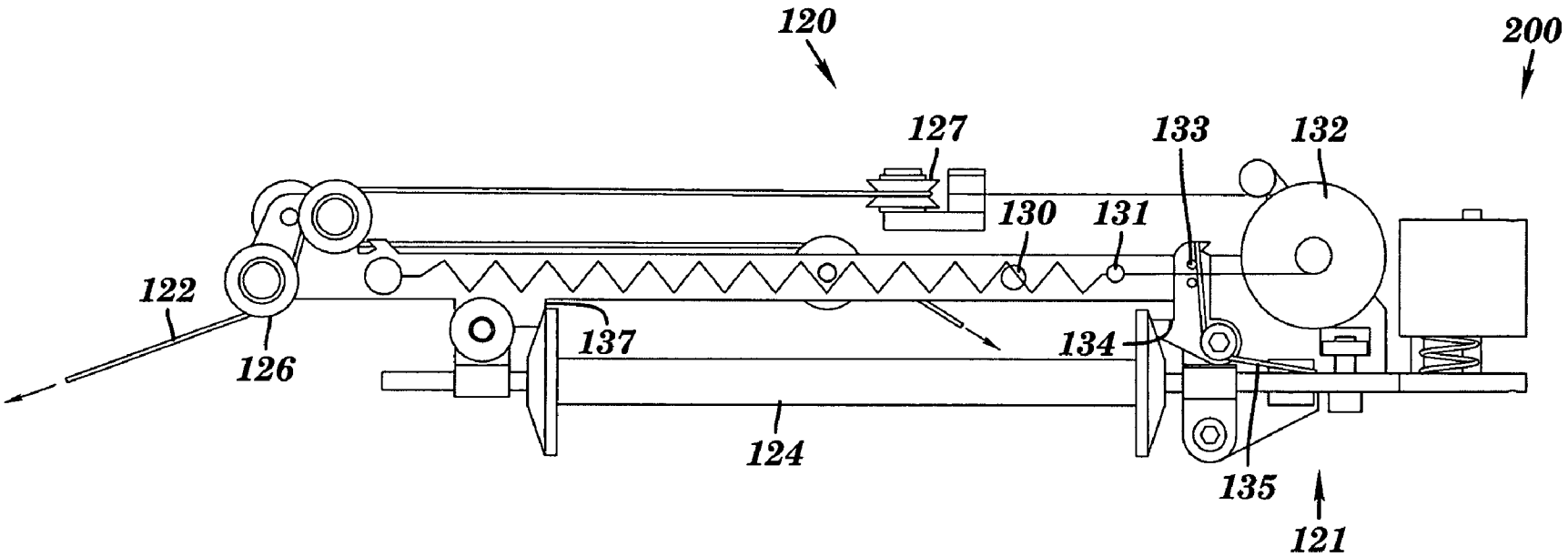

Proper operation of the device as embodied in FIGS. 1 and 3 generally requires that tension in the bias yarns be regulated as distance between the bias carriers 120 and the woven product varies. Turning now to FIGS. 6A and 6B, one exemplary embodiment of bias carriers 120 is described in more detail. In this embodiment, the bias carriers 120 include various yarn tensioning components shown at 121 and various bias shifting components shown at 200 and described above with respect to FIGS. 4A through 5B. The tensioning components 121 include a spool 124 for holding a length of bias yarn 122. In certain advantageous embodiments the spool 124 is relatively large and capable of holding 30 or more meters of bias yarn 122. The bias yarn is then guided through a series of pulleys 126, 127 as it is released to the woven product 105 (FIG. 1A). As bias yarn 122 is pulled from a bias carrier 120 through guide pulleys 126, floating pulley 127 is pulled forward (towards the guide pulleys 126). Movement of floating pulley 127 towards guide pulleys 126 stretches tensioning spring 130, which is coupled through a multi-diameter (e.g., two-diameter) pulley 132 to floating pulley 127. As the floating pulley 127 approaches the end of its range of motion, a bead 131 at the one end of the spring engages catch pins 133 on release lever 134. Prior to such engagement the release lever 134 is preloaded against the spool 124 by torsional spring 135, thereby preventing rotation of the spool 124. As the bead 131 impinges on the catch pins 133, the release lever 134 is lifted off the spool 124, allowing it to rotate and thereby release additional bias yarn 122. It will be appreciated that other suitable release mechanisms may likewise be utilized. For example, the bead 131 (or any other suitable object) may alternatively be located on the floating pulley 127 or on the linkage between the floating pulley 127 and the spring 130.

To ensure that even a minimal increase in tension causes the spool 124 to release additional yarn, mechanical advantage may be provided between the floating pulley 127 and the spring 130. In the exemplary embodiment shown on FIGS. 6A and 6B, such mechanical advantage is provided through the use of the multi-diameter pulley 132 and the geometry of the release lever 134. As shown, pulley 132 has two distinct diameters, with the floating pulley 127 coupled to the larger diameter, while spring 130 is coupled to the smaller diameter. The skilled artisan will recognize that this arrangement provides mechanical advantage that enables spring 130 to be moved using less force than would be required in the event a conventional one-diameter pulley were used.

Additionally, a torsional spring 135 having a relatively small spring constant may be utilized. Furthermore, in the exemplary embodiment shown, the spool 124 is configured to translate along its longitudinal axis so that the release lever 134 urges it against a high friction surface 137 prior to engagement by bead 131. This braking action helps ensure that spool 124 is adequately secured prior to release of additional yarn, yet releases easily when bead 131 engages catch pins 133.

It will be appreciated that the above-described tensioning mechanism operates without applying a frictional or other drag to the bias yarn. The yarn tension is set by the extension of the tensioning spring 130, rather than by applying a fixed resistance to spool 124 to resist yarn pay out. As such, the approach of this embodiment may be used without regard to the variation in torque applied by the yarn to the spool 124 as the spool empties and its' effective diameter decreases. Problems associated with excess spool rotation and slack yarn are advantageously mitigated, and wear and damage of the yarn itself (as might be caused by a drag applied directly to the yarn) are minimized.

Figure 7A:
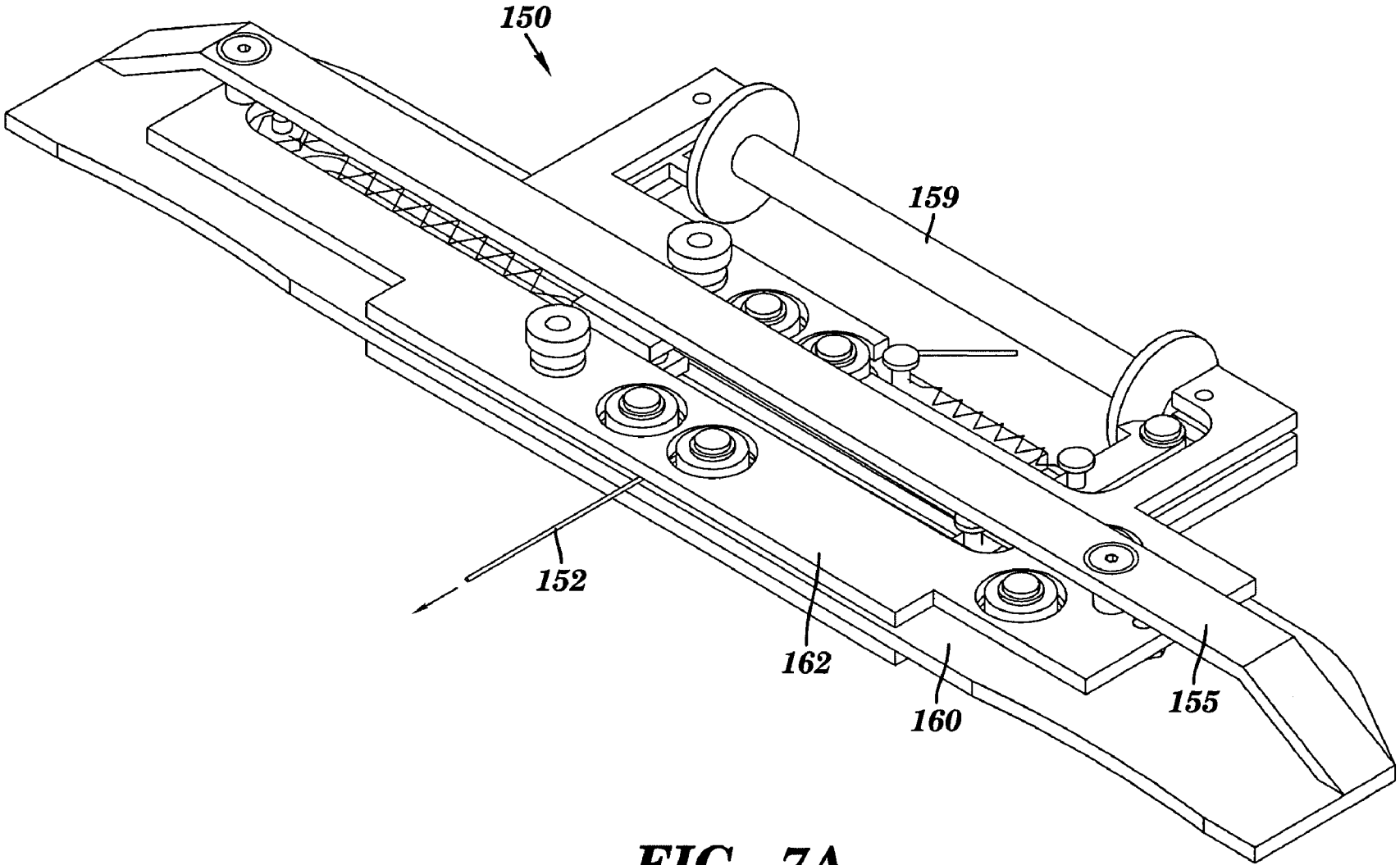
FIGS. 7A and 7B are isometric and top views of a fill shuttle portion useful with the embodiment shown in FIG. 1A.
Figure 7B:
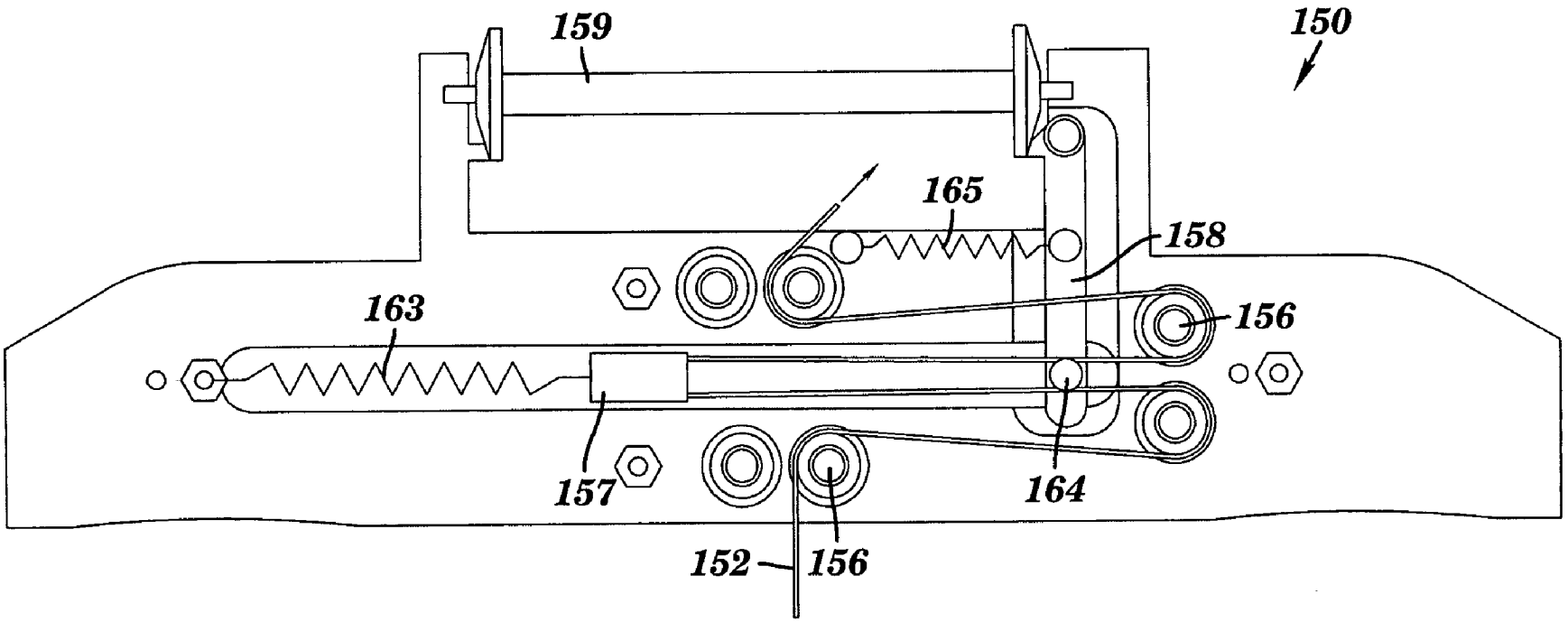

With reference now to FIGS. 7A and 7B, one exemplary embodiment of shuttle 150 is described in more detail. While the yarn tensioning mechanism utilized in shuttle 150 may be similar to that utilized in the bias carriers 120, it will be appreciated that substantially any suitable shuttle configuration be utilized in this invention for translating fill yarn back and forth through the shed 112 (FIG. 1C). It will also be appreciated that such shuttles may utilize substantially any suitable yarn tensioning mechanism.

The exemplary embodiment shown includes a main plate (or frame) 160 interposed between first and second capture plates 162. The shuttle further includes upper and lower thread guards 155 (upper thread guard 155 is shown in FIG. 7A), which are intended to prevent the warp yarns 110 in the shed 112 from engaging (tangling) with the shuttle 150. When assembled (as shown in FIG. 7A), the fill yarn 152 is captured between one of the capture plates 162 and the main plate 160. This allows the yarn extending from the shuttle to go slack without disengaging the pulleys. The fill yarn 152 is routed through a series of cylindrical pulleys 156 to a spool 159. As the fill yarn 152 is pulled from the shuttle 150, floating pulley 157 is pulled towards release lever 158 against the bias of tension spring 163. After sufficient fill yarn has been removed from the shuttle 150, floating pulley 157 contacts catch pin 164 and urges release lever 158 away from the spool 159 against the bias of release spring 165. In this manner additional fill yarn 152 is released from the spool 159.

Figure 8A:
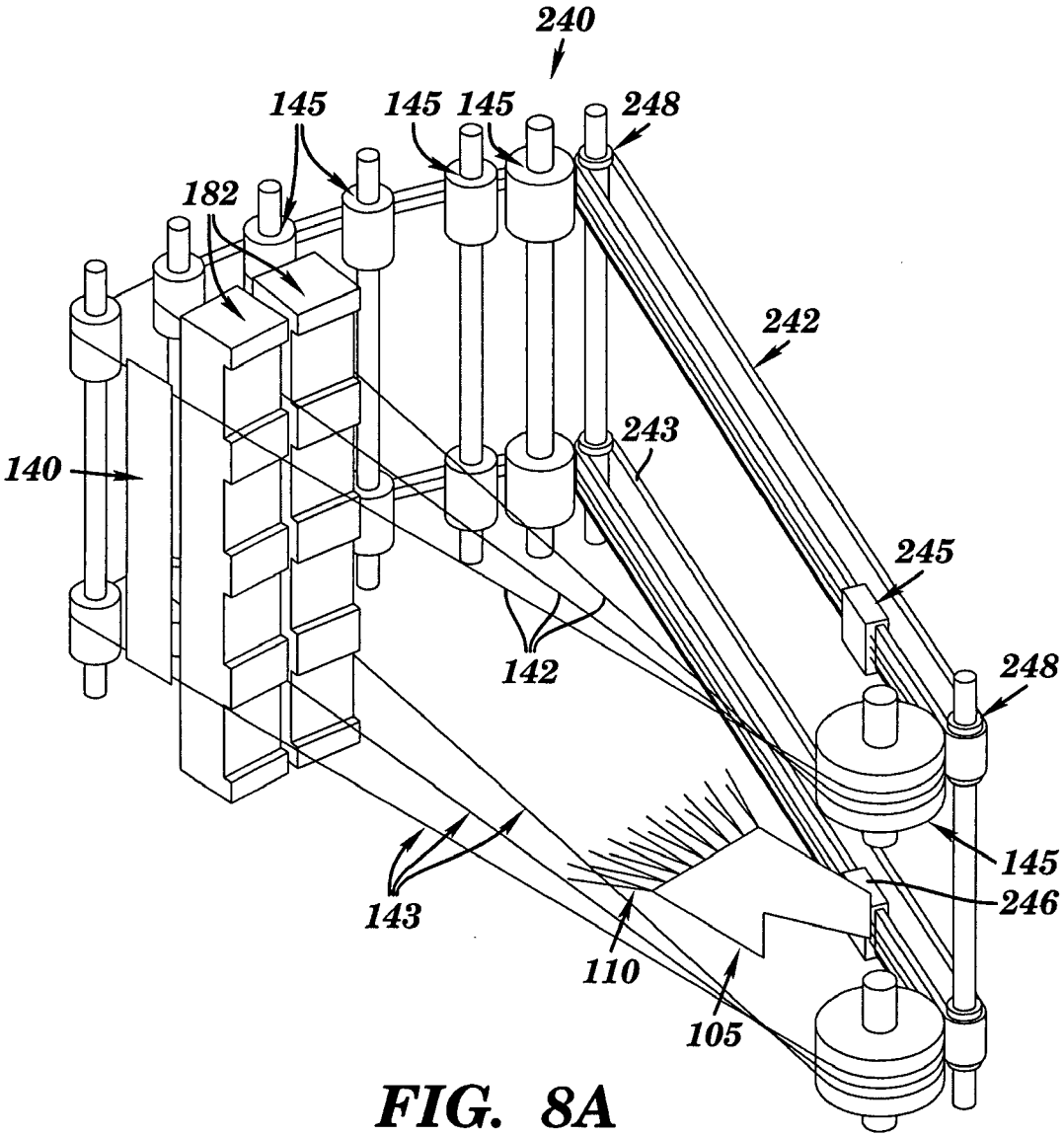
FIGS. 8A, 8B, and 8C are isometric, schematic views of a reed blade control system in accordance with this invention.

As described above, reed blades 140 are utilized to comb newly inserted fill 152 and bias 122 yarns up to the edge (also referred to as the fell) of the woven product 105. Exemplary embodiments of this invention utilize a reed blade control apparatus 240 (see, e.g., FIG. 8A) that enables the reed blades to have a range of motion extending from a position upstream of (i.e., behind) the bias carriers 120 (as shown in FIGS. 1B and 8A) to the woven product 105 located downstream of the bias carriers 120. It will be appreciated that this invention is not limited to any particular reed blade control apparatus. Rather, substantially any control apparatus may be utilized to move the reed blades between the woven product 105 and positions behind the bias carriers 120.

Figure 8B:
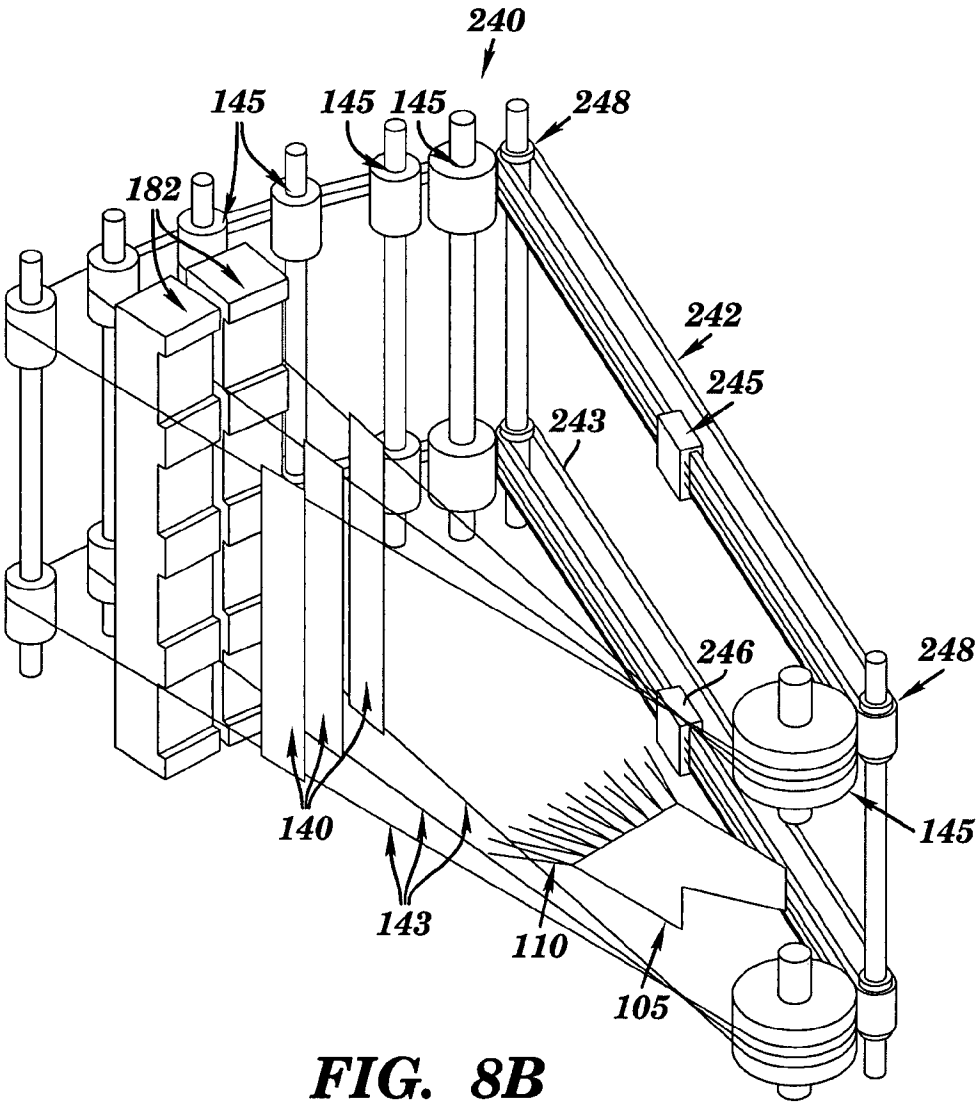
Figure 8C:
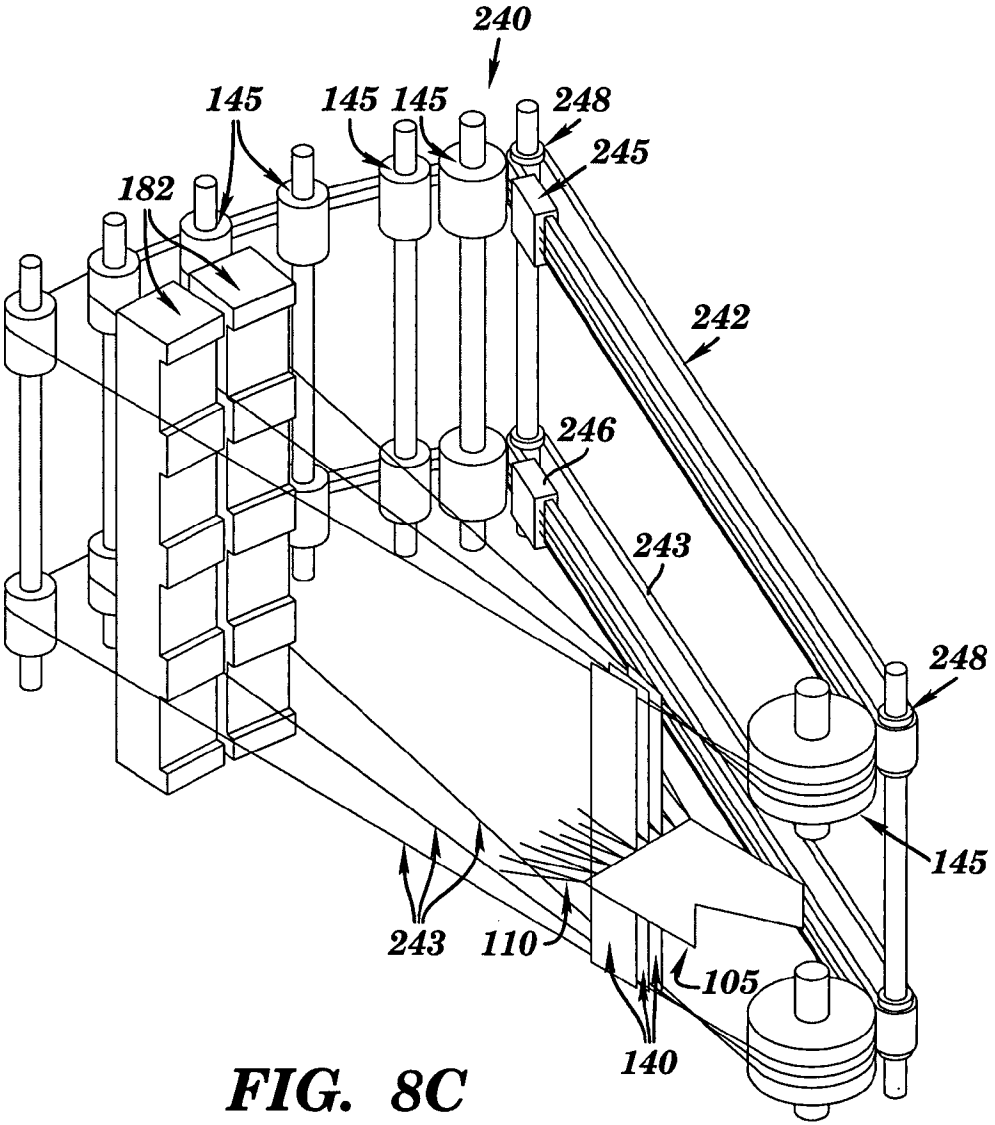

With reference now to FIGS. 8A through 8C, one exemplary embodiment of a control apparatus 240 for the reed blades 140 is described in more detail. In the embodiment shown, each individual reed blade 140 is supported and driven by upper 142 and lower 143 tensioned moveable cables. In one advantageous embodiment, the cables 142 and 143 are looped about a plurality of idler pulleys 145 deployed coaxially about the periphery of the weaving apparatus 100 (FIG. 1A). Forming the cables into loops tends to be advantageous in that the tension on each loop may be maintained in a relatively straightforward manner, for example by the inclusion of a turnbuckle-like device or moveable tensioning pulley in each loop. Each pair of cables 142 and 143 loops about at least one pair of idler pulleys 145 deployed upstream of the bias shuttle 180 and a pair of idler pulleys 145 deployed downstream of the woven product 105. It will be appreciated that those of ordinary skill in the art will conceive of many equivalent paths and configurations for locating the cables and pulleys. In the embodiment shown, the pulleys 145 may be mounted to substantially any fixed component of the apparatus, for example, to a machine chassis (not shown) and may be advantageously configured to serve multiple loops of cable. A portion of the cable loops 142 and 143 are deployed to run along the desired trajectories of the respective blades 140, with one pair of cables coupled to each blade 140 (e.g., at opposing ends of the blade). As such, the cables are configured to pull substantially simultaneously in the appropriate direction to move the reed blades 140 towards and away from the woven product 105 (selectively downstream towards woven product 105 or upstream away from the woven product 105). In the embodiment shown, one pair of cables runs between each adjacent pair of columns.

Control apparatus 240 further includes upper and lower drive belts 242 and 243 deployed coaxially about drive pulleys 248. In one advantageous embodiment, the drive belts 242 and 243 include a plurality of teeth (not shown)

that are configured to engage with the drive pulleys 248, one of which is driven, for example, by an electric motor. The upper 242 and lower 243 drive belts and the upper 142 and lower 143 cable loops are coupled to common upper 245 and lower 246 drive blocks, with the drive blocks 245 and 246 being driven by the drive belts 242 and 243. The above described arrangement advantageously ensures that the upper and lower drive blocks 245 and 246, and therefore the upper 142 and lower 143 cable loops, are driven together at the same rate. As such, the plurality of reed blades 140 is constrained to move substantially simultaneously. Moreover, since each component in the drive train is positively located with respect to each adjacent component, the position of the reed blades 140 tends to be accurately maintained. It will be appreciated that numerous modifications may be made to the above-described control apparatus 240. For example, multiple drive trains may be utilized to provide independent motion control to various groups of (or individual) reed blades 140.

It will be appreciated that during a typical weaving operation, the reed blades 140 are typically repeatedly moved from a position upstream of the bias carriers 120 to the woven product 105 and back, for example as shown in FIGS. 8A and 8C, respectively. During beat-up the reed blades 140 are moved into contact with the woven product 105, as shown in FIG. 8C, to comb various bias and fill yarns into the weave. In order to reposition the warp and/or bias yarns, the reed blades must generally be retracted. However, during operations in which only the warp yarns are repositioned (e.g., using a Jacquard control system as described above with respect to FIG. 2) the reed blades 140 need not be fully retracted. Instead they may be located at an intermediate position between the columns 182 and the woven product 105 as shown in FIG. 8B. During operations in which the bias yarns are repositioned, the reed blades 140 are typically retracted to a position behind the columns 182 as shown in FIG. 8A. This exemplary control apparatus 240 thus provides retraction of the reed blades 140 sufficient to permit both the warp and bias yarns to be repositioned, while advantageously remaining interposed between the warp yarns. Such continuous interposition effectively prevents the reed blades 140 from becoming misaligned relative to the warp yarns, as may otherwise occur in prior art approaches in which the blades are repeatedly moved into and out of such interposition.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

What is claimed is:

1. An apparatus for weaving three dimensional structures which include a plurality of warp yarns, and a plurality of bias yarns, the apparatus comprising:

the warp yarns extending in a downstream direction to form a shed;

a plurality of bias yarn carriers;

the bias yarns extending from the yarn carriers in the downstream direction;

a bias shuttle configured to releasably engage at least one of the plurality of yarn carriers to translate the engaged yarn carriers substantially transversely to the downstream direction;

a plurality of reeds disposed to comb the bias yarns in the downstream direction; and the reeds having a range of motion extending between positions upstream and downstream of the yarn carriers.

2. An apparatus for interweaving of yarns comprising:

a plurality of yarn carriers, each carrier holding a yarn under tension, said yarns extending in a downstream direction from an end supported by the carriers, towards a woven product;

a plurality of reeds disposed to comb the yarns in the downstream direction;

the reeds having a range of motion extending between positions upstream and downstream of the yarn carriers;

the yarn carriers translatable in at least one direction other than the downstream direction.

3. The apparatus of claim 2, wherein a plurality of warp yarns extend from a position upstream of the yarn carriers to the woven product.

4. The apparatus of claim 3, wherein said warp yarns are moveable in at least one direction other than the downstream direction to form a shed.

5. The apparatus of claim 4, wherein:

said yarn carriers are moveable to form an opening among the yarns that extends from the yarn carriers to the woven product; and a fill yarn is moveable through the shed and through the opening, in a direction substantially perpendicular to the downstream direction.

6. The apparatus of claim 5, wherein said yarn carriers are translatable through the shed when the reeds are upstream of the yarn carriers.

7. The apparatus of claim 4, wherein said yarn carriers are translatable through the shed when the reeds are upstream of the yarn carriers.

8. The apparatus of claim 2, wherein:

said yarn carriers are moveable to form an opening among the yarns that extends from said yarn carriers to the woven product; and a fill yarn is moveable through the opening in a direction substantially perpendicular to the downstream direction.

9. The apparatus of claim 8, wherein said yarn carriers are translatable through the shed when the reeds are upstream of the yarn carriers.

10. The apparatus of claim 3, wherein the reeds remain in interposed alignment with the warp yarns throughout said range of motion.

11. The apparatus of claim 2, wherein the reeds are disposed upstream of the yarn carriers when the yarn carriers are translated.

12. The apparatus of claim 2, comprising a bias shuttle configured to releasably engage at least one of the plurality of yarn carriers to translate the engaged yarn carriers substantially transversely to the downstream direction.

13. The apparatus of claim 3, comprising:

a bias shuttle configured to releasably engage at least one of the plurality of yarn carriers to translate the engaged yarn carriers substantially transversely to the downstream direction; and the bias shuttle being configured to translate the engaged bias fiber holders within the shed.

14. The apparatus of claim 13, wherein the bias shuttle is configured to translate the engaged yarn holders to any one of a plurality of positions selected so that each of the plurality of warp yarns is disposed between two of the plurality of positions.

15. The apparatus of claim 14, wherein the bias shuttle is configured to translate the engaged bias yarn holders substantially horizontally.

16. The apparatus of claim 3, comprising a plurality of heddles, each heddle configured to engage one of the plurality of warp yarns and independently translate the engaged warp yarn to form the shed.

17. The apparatus of claim 16, wherein the heddles are configured to translate the engaged warp yarns vertically between at least one upper warp position and at least one lower warp position.

18. The apparatus of claim 16, wherein the plurality of heddles are actuated by a Jacquard or dobby.

19. The apparatus of claim 2, wherein each yarn holder includes a self-contained yarn tensioner.

20. The apparatus of claim 14, wherein the bias shuttle is configured to translate the yarn holders within the shed.

21. The apparatus of claim 14, wherein the bias shuttle includes a plurality of opposable engagement members configured to opposably engage one or more of the plurality of yarn holders.

22. The apparatus of claim 21, wherein said engagement members are configured to asynchronously, alternately engage and release the yarn holders to translate the engaged yarn holders.

23. The apparatus of claim 22, wherein the engagement members each comprise a plurality of fingers having distal ends configured for disposition within the shed, said distal ends configured to releasably engage the yarn holders.

24. The apparatus of claim 22, further comprising a plurality of supports each defining a plane that remains interposed between adjacent ones of said warp yarns during operation of the apparatus.

25. The apparatus of claim 24, wherein said supports are each configured to releasably engage a yarn holder.

26. The apparatus of claim 25, wherein said supports are each provided with a range of motion within their respective planes.

27. The apparatus of claim 26, wherein said supports are each configured to move a yarn holder within their range of motion.

28. The apparatus of claim 27, wherein the range of motion is vertical.

29. The apparatus of claim 24, wherein said engagement members are configured to pass the yarn holders among said supports.

30. The apparatus of claim 4, comprising a weave shuttle configured to pass fill yarn through the shed.

31. The apparatus according to claim 30, wherein at least one of the weave shuttle and the yarn holders comprises a self-contained yarn tensioner.

32. The apparatus of claim 31, wherein the self-contained yarn tensioner comprises a spring operatively engaged with a release.

33. The apparatus of claim 32, wherein the release comprises a force release.

34. The apparatus of claim 32, wherein the release comprises a displacement release.

35. The apparatus of claim 34, further comprising a displacement trigger operatively engaged with the release.

36. An apparatus for interweaving of yarns comprising:

a plurality of yarn carriers, each carrier holding a yarn under tension, the yarns extending in a downstream direction from an end supported by the carriers, to a woven product;

a bias shuttle configured to releasably engage at least one of the yarn carriers to translate the at least one yarn carrier relative to at least one other of the yarn carriers, in a direction substantially orthogonal to the downstream direction;

the bias shuttle including a plurality of opposable engagement members configured to opposably engage one or more of the plurality of yarn carriers; and said engagement members being configured to asynchronously, alternately engage and release the yarn carriers to translate the engaged bias yarn carriers.

37. The apparatus of claim 36, wherein:

said yarn carriers are moveable to form an opening among the yarns that extends from said yarn carriers towards the woven product; and a fill yarn is moveable through the opening in a direction substantially orthogonal to the downstream direction.

* * * * *